US008840441B2

(12) United States Patent
Sporn

(10) Patent No.: US 8,840,441 B2
(45) Date of Patent: Sep. 23, 2014

(54) CINCH BRA SYSTEM AND METHOD

(76) Inventor: Joseph S. Sporn, New York, NY (US)

( * ) Notice: Subject to any disclaimer, the term of this patent is extended or adjusted under 35 U.S.C. 154(b) by 93 days.

(21) Appl. No.: 13/282,085

(22) Filed: Oct. 26, 2011

(65) Prior Publication Data

US 2013/0109276 A1 May 2, 2013

(51) Int. Cl.
*A41C 3/00* (2006.01)
*A41C 3/10* (2006.01)

(52) U.S. Cl.
CPC ..... *A41C 3/10* (2013.01); *A41C 3/0028* (2013.01)
USPC ..... 450/38; 450/57; 450/54

(58) Field of Classification Search
USPC ..... 450/38, 54–57, 39, 81, 86, 88; 2/267, 2/268; 623/7, 8
See application file for complete search history.

(56) References Cited

U.S. PATENT DOCUMENTS 3,221,748 A * 12/1965 Glasser ..... 450/56
6,443,805 B1 * 9/2002 Kirkwood ..... 450/31
6,530,820 B1 * 3/2003 Katze et al. ..... 450/7
6,780,081 B2 * 8/2004 Chen et al. ..... 450/81
6,852,001 B2 * 2/2005 Chen et al. ..... 450/57
6,916,224 B2 * 7/2005 Chen et al. ..... 450/57
7,052,359 B2 * 5/2006 Chen et al. ..... 450/54
7,144,296 B2 * 12/2006 Chen et al. ..... 450/81
7,407,429 B2 * 8/2008 Chen ..... 450/54
8,113,910 B2 * 2/2012 Fortner ..... 450/81
2007/0289047 A1 * 12/2007 Fortner ..... 2/268
2012/0108143 A1 * 5/2012 Sherwood ..... 450/57

* cited by examiner

*Primary Examiner* — Gloria Hale

(57) ABSTRACT

Disclosed is a bra for female breast support and formation that is particularly suited to provide the wearer a choice of support and shaping parameters. The bra comprises a pair of interconnected breast receiving cups, a conventional back strap and optional shoulder straps. A pair of skin gripping pads are sized and positioned to fit within the respective cups in a position to embrace the under and lateral side of the respective breast and include a selectively adjustable link interconnecting the support pads across and under the medial port ion of the bra. By shortening the link the support pads move laterally, drawing the breasts together. In a second embodiment the support pads may also be adjusted up and down by shortening or lengthening secondary shoulder straps that are attached to the upper portion of the respective pads and are positioned underneath the conventional bra shoulder straps.

9 Claims, 4 Drawing Sheets

CINCH BRA SYSTEM AND METHOD

FIELD OF THE INVENTION

The present invention relates to garments for female breast support and formation and in particular to provide the wearer with a choice of support parameters.

BACKGROUND OF THE INVENTION

Brasseries, commonly referred to as bras, are well known garments worn by women to support, shape and lift their breasts. The prior art is replete with patents on apparatus and methods adapted to enhance the basic objectives of a bra. Examples of these prior efforts are found in U.S. Pat. No. 2,468,106 for Bust Support, U.S. Pat. No. 2,621,238 for Breast Supporting Garment, U.S. Pat. No. 2,915,067 for Body Supporting Garment and in published patent application No. 2005/0277364 for Adjustable Lifting Bra.

The object of the present invention is to improve on and simplify the prior art structures and methods of lifting and shaping the female breast.

SUMMARY OF THE INVENTION

The shaping bra of the present invention includes a pair of interconnected breast receiving cups that are maintained in place on the body by an attached back strap and, if required or desired, shoulder straps. A pair of tear drop shaped soft shaping pads constructed of silicon rubber, or other suitable material that has skin adhering properties, are disposed within the respective cups of the bra so that the narrow ends of the pads face the medial axis of the body. A flexible adjusting cord is trained through apertures in the narrow ends of the each of the shaping pads and forms a closed loop whose length is selectively adjustable. Cinching the loop to draw the pads together applies lateral pressure against each of the breasts to pull them together for improved shaping and formation of cleavage.

In a second embodiment of the bra of the present invention, each of the tear drop shaped pads is also attached, at the upper portion of its large oval end, to the front end of a respective inside one of a two overlying shoulder straps. The inside adjusting shoulder strap is separate from the outside shoulder strap which has a conventional slide adjustment for proper positioning of the basic bra shell. The back facing terminal ends of both the inside and outside shoulder straps are attached to the back strap. In this second embodiment a separate adjusting slide on the inside shoulder strap allows the attached supporting and lifting pad to be lifted toward the wearer's shoulder putting upward lifting pressure on the breast that cooperates with the lateral pressure produced by the medial cinch cord to provide a double adjustment for shaping each breast.

DETAILED DESCRIPTION

Figure 3:
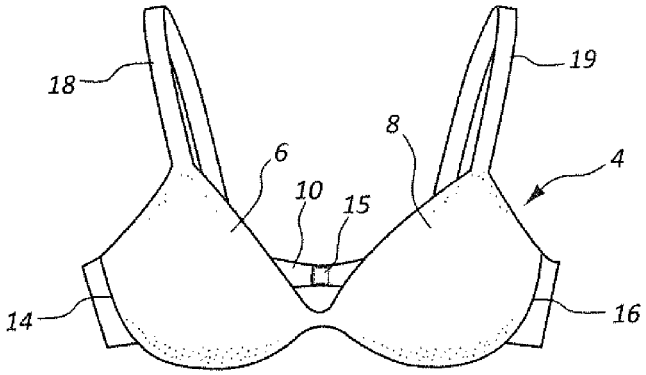
FIG. 3 is a front view of a shell form of a breast supporting garment.

A basic shell form of a breast supporting garment (brasserie or bra) 4 is shown in FIG. 3. The bra comprises interconnected and spaced apart breast receiving cups 6 and 8. A back strap 10 have a back clasp 15 for encirclement of the wearer's chest and back is attached at its terminal ends to the lateral side portions 14 and 16 of the cups. Supporting shoulder straps 18 and 19 are attached at their one end to the upper portions of the respective cups 6 and 8 and attached at their other end to the back strap 10.

Figure 1:
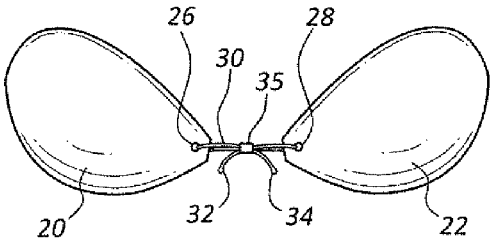
FIG. 1 is a front view of the bra supporting pads showing the cinching loop that interconnects the pads in its expanded position.
Figure 2:
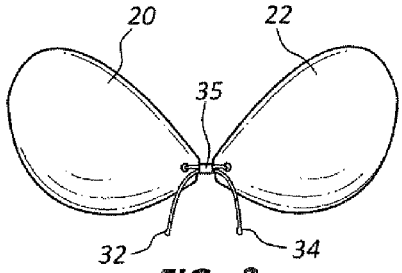
FIG. 2 is a front view of the bra supporting pads showing the cinching loop that interconnects the pads in its cinched or retracted position.
Figure 4:
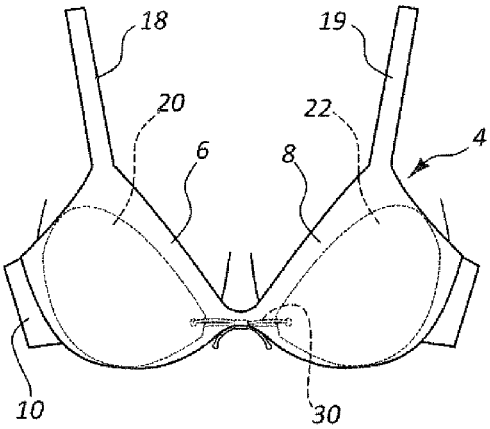
FIG. 4 is a front view of the shell bra with the inserted supporting pads shown in dotted lines and the cinching loop in the same configuration as shown in FIG. 1.
Figure 5:
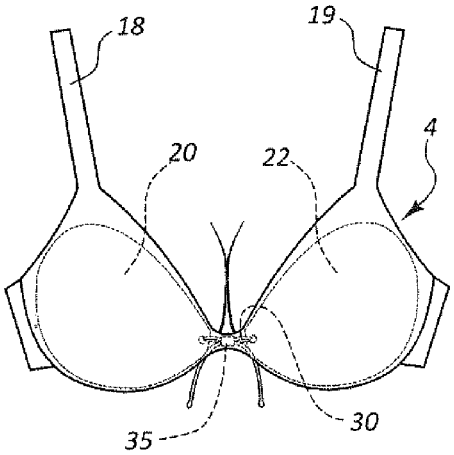
FIG. 5 is a front view of the shell form of bra with the inserted supporting pads shown in dotted lines and the cinching loop in the same cinched configuration as shown in FIG. 2.
Figure 6:
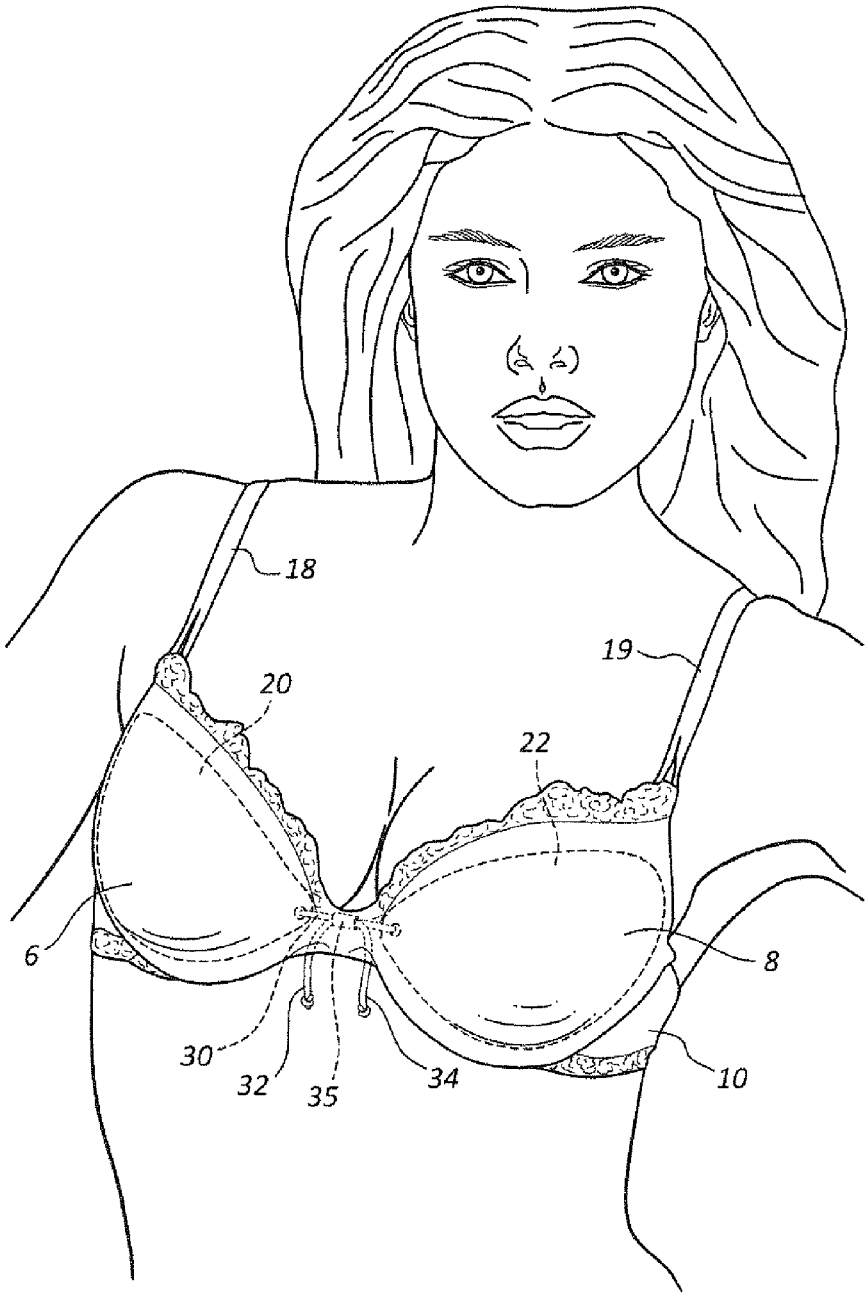
FIG. 6 is a perspective view of the cinch bra of the present invention as worn by a female figure and illustrating the increased cleavage attained by cinching together the supporting bra pads within the exterior shell bra.
Figure 7:
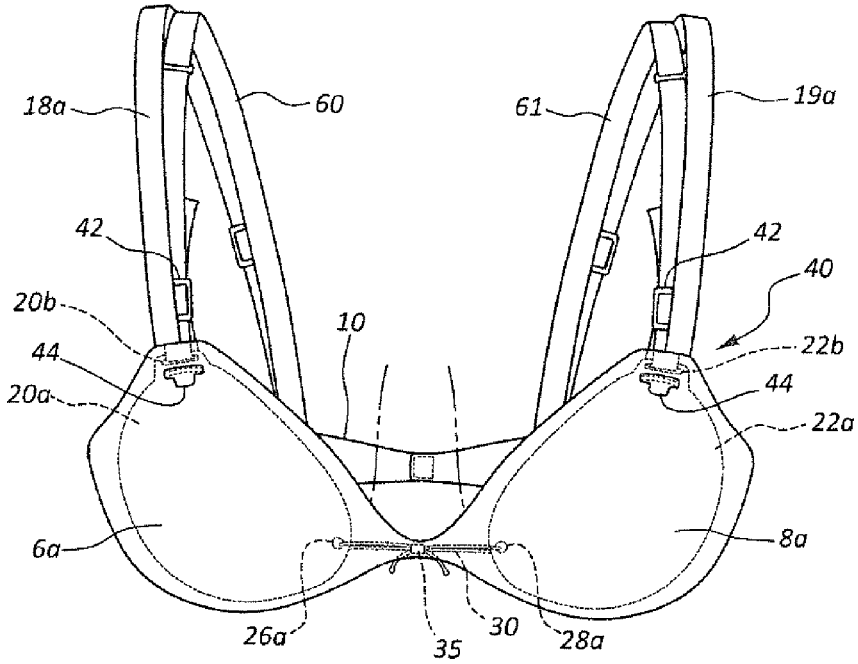
FIG. 7 is a front view of the second embodiment of the bra of the present invention with the inserted supporting pads shown in dotted lines and the cinch cord in its uncinched or loose position.
Figure 8:
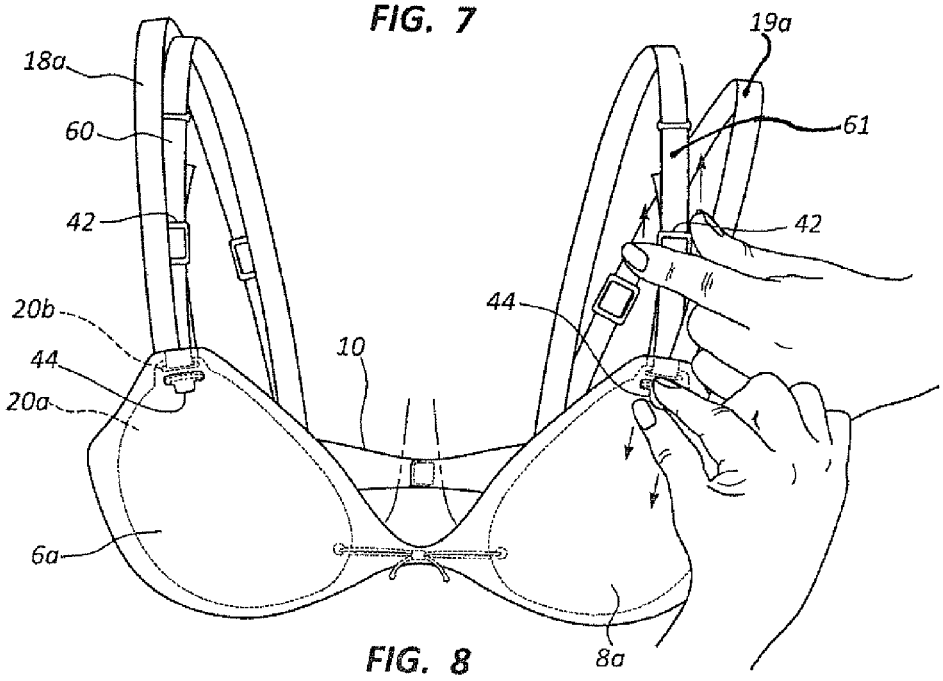
FIG. 8 is a view similar to that of FIG. 7 but including representative hands and fingers to better illustrate the adjustment technique.
Figure 9:
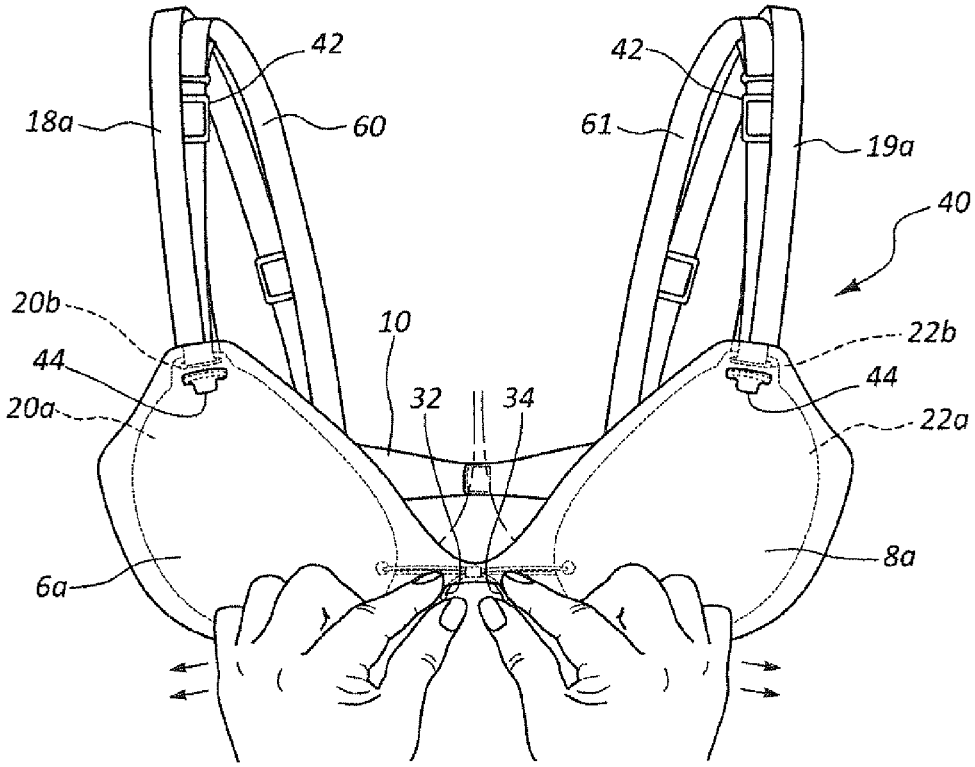
FIG. 9 is a view similar to that of FIG. 7 but including but where the inside shoulder straps and attached lifting pads are shown in a fully lifted position and representative hands and fingers depict the tightening adjustment of the medial cinching cord.
Figure 10:
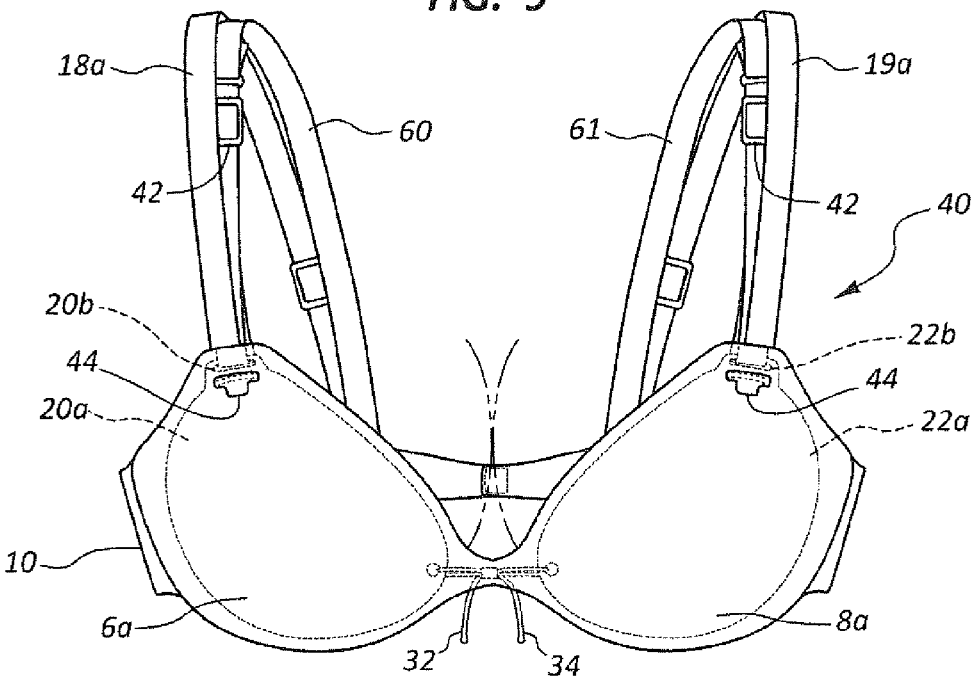
FIG. 10 is a front view of the bra of the second embodiment where both the cinching cord and shoulder straps are fully adjusted to the maximum lifting position.

Each one of a pair of tear drop shaped breast supporting pads 20 and 22 is sized to be inserted between the skin of the breast and the inside surface of the respective breast receiving cups 6 and 8, as shown by the dotted lines in FIGS. 4 and 5. The supporting pads are constructed of soft material whose surface has a tendency to cling or grip the breast skin. Silicon rubber is exemplary of such material. The narrow ends of each of the pads contain apertures 26 and 28 into which is trained a flexible cord that forms a cinching loop 30. The length or size of the loop may be reduced by drawing the ends 32 and 34 of the loop-forming cord through a clasp 35 which maintains the cord ends in a selected position that shortens the loop 30 and draws the supporting pads together, as shown in FIGS. 2, 5 and 6. When the pads are pulled together by shortening the loop 30, the breasts are drawn together, as shown in FIGS. 5 and 6, by the gripping and clinging action of the pads on the skin of the breasts. The cinching loop may be expanded to the size shown in FIGS. 1 and 4 by releasing the clasp 32 and allowing the breasts to assume their more natural position within a normal bra, as shown in FIG. 4.

By providing the independently adjustable pads 20 and 22 within the shell bra 4 the supporting and lifting adjustment can be made without having bulky and uncomfortable means for the additional support that are integral with the basic bra, as in the prior art. Furthermore, the selective adjustment of the pad connecting loop 30 provides a choice for the wearer that can be quickly and easily implemented.

A second embodiment of the invention includes a second and more definitive lifting adjustment that adds to the lateral adjustment of the bra of the first embodiment shown in FIGS. 1-6.

The breast receiving cups 6*a* and 8*a* are similar to the cups 6 and 8 of the first embodiment except for the presence of tabs 44 attached to the top outside surface of each of the cups 6*a* and 8*a*. The supporting and lifting pads 20*a* and 22*a* are similar to the pads 20 and 22 of the first embodiment except that the pads are equipped at their top ends with an elongated laterally oriented opening 20*b* and 22*b* that forms a D ring in the top portion of each pad. Into each opening is inserted the ends of inside shoulder straps 60 and 61 which are then trained into respective adjustment buckles 42 retained on each strap. By sliding the buckle 42 upwardly toward the shoulder while holding the bra shell 4 in place with the tab 44, the interior supporting pad is lifted, drawing the breast upwardly in a fashion similar to that describing for the lateral squeezing adjustment provided by tightening of the cinching cord 30.

What is claimed is:

1. A breast supporting garment comprising, a pair of interconnected breast receiving cups each cup having medial and lateral side portions and an upper portion, a back strap having terminal ends that are attached to the lateral side portions of the cups, a pair of shaping pads sized to fit within the respective cups, where the support pads are constructed of silicon rubber and where each of the pads are teardrop shaped having an oval lateral portion diverging into a narrow medial portion, an adjustable link interconnecting the medial ends of the pads, including, a single aperture disposed in the narrow medial portion of each pad, and a flexible cord trained through each of the apertures and forming a loop of selectively adjustable size.

2. The garment of claim 1 and further including, right and left shoulder straps each having anterior and posterior ends whose anterior ends are adjustably attached to the oval lateral portion of the respective shaping pads;

an adjustment buckle carried by each of the shoulder straps which is operatively engaged with the anterior end of the same shoulder strap to adjust the length of the strap and the position of the pad to which it is attached.

3. The garment of claim 2 and further including, a tab attached to the upper portion of each of the breast receiving cups.

4. A breast supporting garment comprising, a pair of interconnected breast receiving cups, each cup having an upper portion, a pair of shaping pads sized to fit within the respective cups, where the support pads are constructed of silicon rubber and where each of the pads are teardrop shaped and have an oval lateral portion diverging into a narrow medial portion, right and left first shoulder straps each having anterior and posterior ends whose anterior ends are adjustably attached to the oval lateral portion of the respective shaping pads;

an adjustment buckle carried by each of the shoulder straps which is operatively engaged with the anterior end of the same shoulder strap to adjust the length of the strap and the position of the pad to which it is attached.

5. The garment of claim 4 and further including, right and left second shoulder straps each having anterior and posterior ends and whose anterior ends are fixedly attached to the respective breast receiving cups.

6. The garment of claim 4 and further including, a tab attached to the upper potion of each of the breast receiving cups.

7. A breast supporting garment comprising, a pair of interconnected breast receiving cups each cup having medial and lateral side portions, a back strap having terminal ends that are attached to the lateral side portions of the cups, a pair of support pads constructed of a material selected from a group having skin adhering qualities and sized to fit within the respective cups where each of the pads is teardrop shaped having an oval lateral portion diverging into a narrow medial portion, a link interconnecting the support pads comprising at least one aperture disposed in the narrow medial portion of each pad and a flexible cord trained through each of the apertures and forming a loop of selectively adjustable size.

8. Breast shaping implements for insertion into the breast receiving cups of a brassiere comprising, a pair of shaping pads sized to fit within the respective cups of the brassiere and each pad comprising a large oval lateral end and a narrow medial end, said pads being constructed of a material selected from a group having skin adhering qualities, a link interconnecting the pads at their medial ends comprising at least one aperture disposed in the narrow medial end of each pad, and a flexible cord trained through the apertures of each pad forming a loop of selectively adjustable size.

9. The implements of claim 8 and further including, a pair of adjustable length shoulder straps each having posterior and anterior ends where the said anterior ends are adjustably connected to the respective shaping pads.

* * * * *